US006679790B2

(12) United States Patent
Soelch

(10) Patent No.: US 6,679,790 B2
(45) Date of Patent: Jan. 20, 2004

(54) ORIENTED THERMOPLASTIC ELASTOMER THREAD WOUND GOLF BALL

(76) Inventor: Richard R. Soelch, 1 Deer Crossing La., Essex Junction, VT (US) 05452

( * ) Notice: Subject to any disclaimer, the term of this patent is extended or adjusted under 35 U.S.C. 154(b) by 0 days.

(21) Appl. No.: 09/899,386

(22) Filed: Jul. 5, 2001

(65) Prior Publication Data

US 2002/0013182 A1 Jan. 31, 2002

Related U.S. Application Data

(60) Provisional application No. 60/215,985, filed on Jul. 5, 2000.

(51) Int. Cl.[7] ..... A63B 37/02

(52) U.S. Cl. ..... 473/356; 156/170; 156/437; 156/167

(58) Field of Search ..... 473/354, 357, 473/360, 362, 351, 356, 361

(56) References Cited

U.S. PATENT DOCUMENTS 4,783,078 A * 11/1988 Brown et al. ..... 473/354
5,679,196 A * 10/1997 Wilhelm et al.
5,685,785 A * 11/1997 Kakiuchi et al. ..... 473/354
6,012,991 A * 1/2000 Kim et al. ..... 473/374
6,030,296 A * 2/2000 Morgan et al. ..... 156/186
6,113,505 A * 9/2000 Boehm ..... 156/186
6,149,535 A * 11/2000 Bissonnette et al. ..... 428/401
6,290,610 B1 * 9/2001 Reid et al. ..... 473/351

FOREIGN PATENT DOCUMENTS

EP 416780 A2 * 3/1991 ..... A63B/37/00

* cited by examiner

*Primary Examiner*—Paul T. Sewell
*Assistant Examiner*—Thanh Duong
(74) *Attorney, Agent, or Firm*—Schmeiser, Olsen & Watts

(57) ABSTRACT

A new, novel and useful Oriented Thermoplastic Elastomer Thread Wound Golf Ball providing improved combinations of good spin for ball control on iron or wedge shots while providing for higher hardness and long travel with driver shots. The Oriented Thermoplastic Elastomer Thread Wound Golf Ball's performance is acheived by the incorporation of oriented thermoplastic elastomer threads in the golf ball design.

6 Claims, 6 Drawing Sheets

Description of Orientated Thermoplastic Elastomer Golf Ball Thread Samples Used in Wound Structure Examples

| SAMPLE | Titleist 1 DT Wound 90 Cummins (blue) | WOTEGBTS-1.0 | WOTEGBTS-1.8cd | WOTEGBTS-2.05cd | WOTEGBTS-4.7 | WOTEGBTS-7.2 |
|---|---|---|---|---|---|---|
| Description | Commercial golf ball rubber thread | Hytrel (R) 4056 control | Hytrel (R) 4056 Oriented | Hytrel (R) 4056 Oriented | Hytrel (R) 4056 Oriented | Hytrel (R) 4056 Oriented |
| Draw Orientation | — | none | 1.8 X cold drawn | 2.05 X cold drawn | 4.7 X | 7.2 X |

*FIG. 1*

FIG. 2
Compressive Resilience Tester
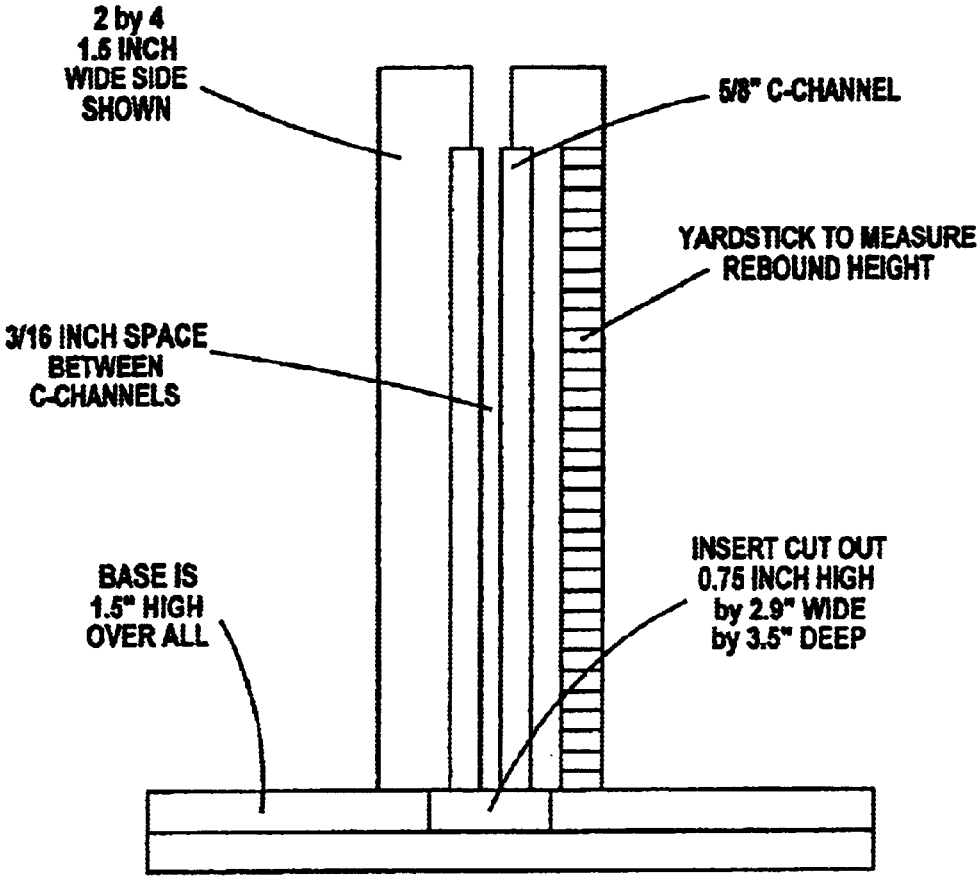
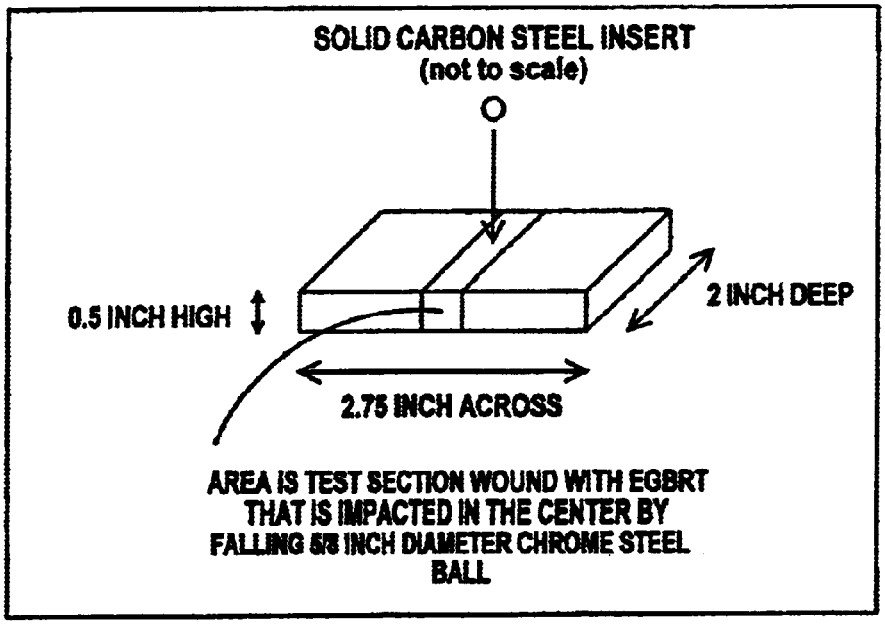

Figure 3: Thread Wound Structure Compressive Resilience
Measured Normal to Major Flat Thread Axis

| Sample | Control Carbon Steel Insert | Titleist 1 DT Wound 90 Cummins (blue) | WOTEGBTS-1.0 | WOTEGBTS-2.05cd | WOTEGBTS-7.2 |
|---|---|---|---|---|---|
| Winding Weight | — | Hand * | 120 g | 940 g | 940 g |
| Rebound (inches) | | | | | |
| 1 | 7.5 | 10.5 | 9.5 | 8.9 | 10.5 |
| 2 | 7.75 | 10 | 9.75 | 8.25 | 10 |
| 3 | 7.25 | 10.25 | 9.75 | 9 | 10 |
| 4 | 7.25 | 9.5 | 10.5 | 9.5 | 10.75 |
| 5 | 7.5 | 10.75 | 9.75 | 10 | 10.25 |
| 6 | | 11 | 10 | 10.25 | 10.75 |
| 7 | | 10.75 | 10.5 | 10.5 | 9.75 |
| 8 | | 11 | 10.5 | 9.5 | 10.75 |
| 9 | | 11 | 10.25 | 10 | 10.25 |
| 10 | | 10 | 10.5 | 10.5 | 10.75 |
| 11 | | 10.75 | 9.5 | 9 | 10.5 |
| 12 | | 10.25 | 10.25 | 9.75 | 10.5 |
| 13 | | 9 | 10.5 | 9.5 | 10.5 |
| 14 | | 10.5 | 10.5 | 9 | 10.75 |
| 15 | | 10.5 | 10.25 | 9.5 | 10.75 |
| 16 | | 10.25 | 10.25 | 9.5 | 10.75 |
| 17 | | 9 | 10.5 | 10 | 11 |
| 18 | | 10 | 10.5 | 9 | 9.75 |
| 19 | | 9.75 | 9.5 | 8.5 | 11 |
| 20 | | 10.75 | | | 10.5 |
| Average | 7.45 | 10.28 | 10.14 | 9.48 | 10.49 |
| Standard Deviation | 0.21 | 0.61 | 0.39 | 0.64 | 0.38 |

* Wound by hand because it stretched beyond limits of tension winder even at low tensions.
** WOTEGBTS-2.05cd had marginal wind because it stretched to limit of tension winder.

Figure 4: Elastic Tensile Deformation
Wound Structure Elastic Properties as a Function of Winding Tension

| Size (inch) | Titleist 1 DT Wound 90 | | | WOTEGBTS-1.0 | | | WOTEGBTS-1.8cd | | | WOTEGBTS-4.7 | | | WOTEGBTS-7.2 | | |
|---|---|---|---|---|---|---|---|---|---|---|---|---|---|---|---|
| | width 0.063 | thickness 0.0236 | | width 0.0709 | thickness 0.02755 | | width 0.04724 | thickness 0.01968 | | width 0.0709 | thickness 0.02755 | | width 0.063 | thickness 0.0236 | |
| Weight lb | Tension (psi) | Extension (max %) | Extension (final %) | Tension (psi) | Extension (max %) | Extension (final %) | Tension (psi) | Extension (max %) | Extension (final %) | Tension (psi) | Extension (max %) | Extension (final %) | Tension (psi) | Extension (max %) | Extension (final %) |
| 0.2643 | 178 | 475 | 100 | 135 | 103 | 100 | Not Tested | | | 135 | 103 | 100 | 178 | 102 | 100 |
| 0.30837 | | | | | | | 332 | 108 | 100 | | | | | | |
| 0.5286 | 356 | 733 | 100 | 271 | 104 | 100 | Not Tested | | | 271 | 107 | 100 | 356 | 107 | 100 |
| 1.013 | 681 | 800 | 100 | 519 | 110 | 100 | Not Tested | | | 519 | 113 | 100 | 681 | 110 | 100 |
| 1.277 | | | | | | | 1374 | 153 | 100.8 | | | | | | |
| 2.026 | 1363 | * 850 | *100 | 1037 | 283 | 161 | Not Tested | | | 1037 | 120 | 100 | 1363 | 119 | 100 |
| 4.05 | 2724 | Broke | | 2073 | 475 | 250 | Not Tested | | | 2073 | 131 | 100 | 2724 | 123 | 98 |
| 6.08 | 4089 | | | 3113 | 550 | 294 | Not Tested | | | 3113 | 140 | 100 | 4089 | 129 | 98 |
| 8.106 | 5452 | | | 4150 | 600 | 325 | Not Tested | | | 4150 | 154 | 100 | 5452 | 131 | 100 |

* Sample snapped outside of measurment zone in less than one minute.
*Final Extension % = (Final length/initial length)*100

Figure 5: Wound Structure Elastic Response Table

| Tension | Titleist 1 DT Wound 90 | WOTEGBTS-1.8cd | WOTEGBTS-4.7 | WOTEGBTS-7.2 |
|---|---|---|---|---|
| 270 | | | 1.00 | |
| 332 | | 1.00 | | |
| 356 | 1.00 | | | 1.00 |
| 519 | | | 1.10 | |
| 681 | 1.09 | | | 1.03 |
| 1037 | | | | |
| 1363 | 1.16 | | | |
| 1374 | | 1.42 | 1.17 | 1.11 |

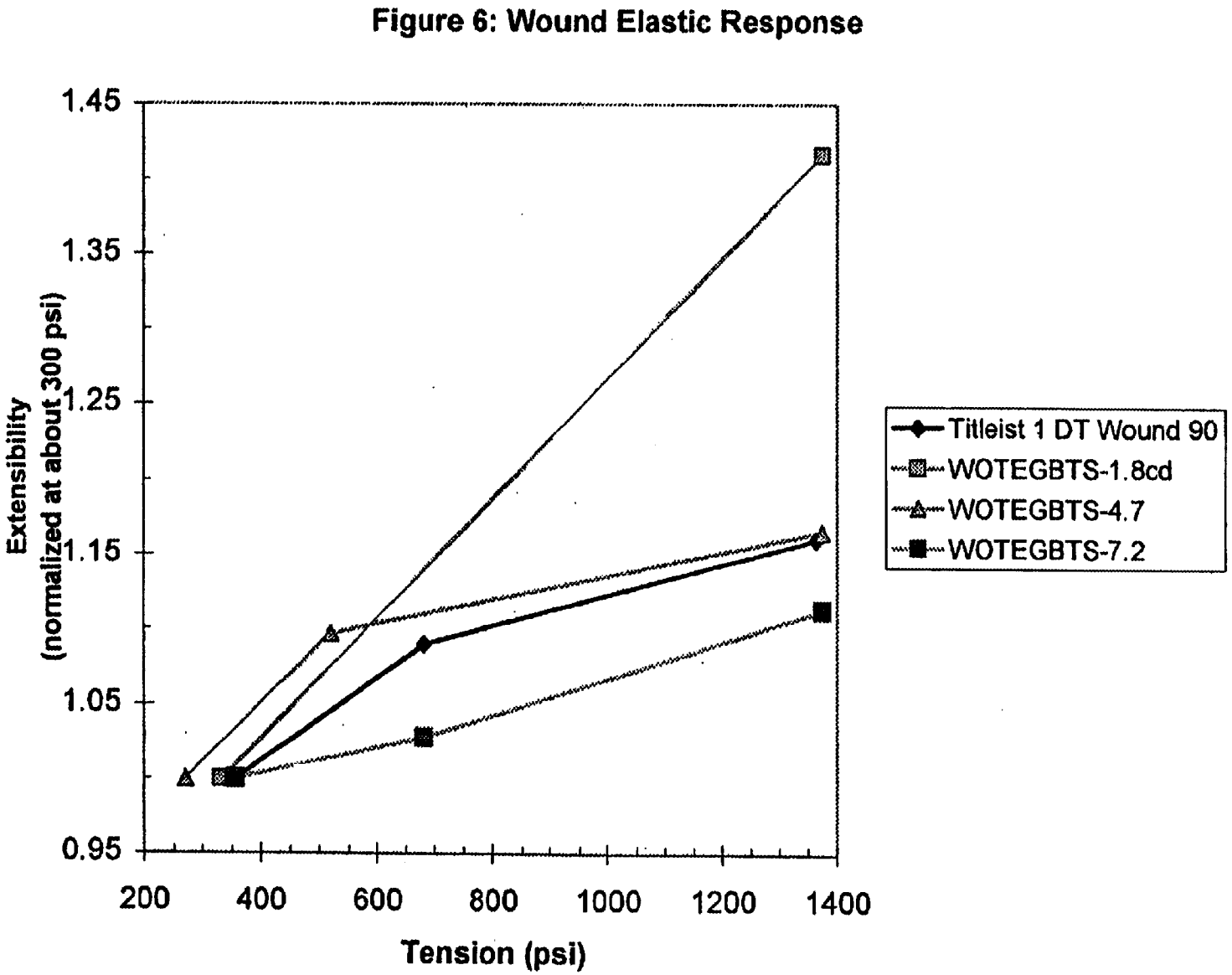
Figure 6: Wound Elastic Response

ORIENTED THERMOPLASTIC ELASTOMER THREAD WOUND GOLF BALL

This application claims the benefit of provisional application 60/215,985 filed on Jul. 5, 2000.

TECHNICAL FIELD OF THE INVENTION

The present invention relates to a thread wound golf ball containing a novel Wound Oriented Thermoplastic Elastomer Golf Ball Thread Structure, (hereinafter referred to as WOTEGBTS). In a preferred embodiment the WOTEGBTS consists essentially of threads comprising oriented polyether esters or oriented polyether amides optionally containing minor amounts of modifying polymers and other additives. The WOTEGBTS provides a thread wound golf ball with improved combinations of good spin for ball control on iron or wedge shots while providing for higher hardness and long travel with driver shots.

Golf balls containing WOTEGBTS are more easily manufactured, of high quality and high performance due to specific attributes of the WOTEGBTS. These attributes are: surprisingly high compressive resiliency; high tensile elasticity; superior strength; recycle ability; excellent durability; and high dimensional uniformity and precision compared with prior art golf ball thread rubber structures. In addition, WOTEGBTS can be readily engineered to have controlled mechanical property profiles, across the thread wound layer, as a function of radial distance from the golf ball center. These unprecedented property profiles can produce novel, different ball response characteristics as a function of the type of shot being played (i.e., type of shot meaning driver, iron or wedge or in mechanical terms essentially the force vector delivered by the club, the club impact area and club face angle).

The property profiles originate in one or a combination of design factors used to make the WOTEGBTS composition. The design factors, or design, together make up one aspect of the invention that is novel and useful and leads to surprising results. The factors that are engineered over the length of thread used in the WOTEGBTS, are: constant mechanical properties; controlled varying mechanical properties; a constant winding tension; a controlled varying winding tension; thread cross sectional shapes or profiles; constant cross sectional areas; controlled varying cross sectional areas. These novel property profiles were not possible with prior art thermoset rubber thread wound golf balls.

BACKGROUND ART

A thread wound golf ball is generally produced by winding thread rubber under tension around a center to form a thread wound core and then providing a covering on the thread wound core. The thread rubber requires high strength sufficient for tightly winding it on a center. The threads must also possess high impact rubber resilience in the stretched or wound condition sufficient for enhancing the flight distance.

U.S. Pat. No. 5,728,011 titled "Thread Wound Golf Ball and Process for Producing the Same" gives a good description of thread rubber typically used, its limitations in terms of uniformity and the lengthy and complex process for making the vulcanized thermoset rubber threads.

Thread rubber used for a thread wound golf ball has generally been produced by molding a raw rubber material into a sheet having a predetermined thickness, winding the raw rubber sheet around a drum having a certain size, vulcanizing using a vulcanizer and cutting the vulcanized rubber sheet into a suitable width. The authors cite problems of frequent thread rubber breakage and the process constraints that lead to varying degrees of thread rubber vulcanization that lead directly to scatter in ball compression and scatter in flight distance.

The process whereby prior art rubber threads for golf balls are produced also relies upon cutting vulcanized rubber sheets into threads. The sheets are thin, often about 0.5 mm and it is difficult to produce these sheets with highly uniform thickness. This results in cut threads having significant variability in thickness. The cutting process is also limited in terms of the cross sectional geometry of the resulting thread to either essentially square or (more preferred) rectangular.

U.S. Pat. No. 4,783,078 "Wound Golf Balls" discloses a two stage winding process for the customary thermoset rubber threads to reduce breaks during thread winding for liquid center golf balls. This winding essentially varies the tensions along the length of thread rubber which changes the winding process to reduce thread breaks. No mention is made of providing an oriented thermoplastic thread wound structure with engineered properties along the length of the thread to adjust the ball performance by use of this method to accommodate both driver and iron/wedge shots.

Japanese Patent Publication JP 5,212,137 A2 discloses a method to fix the thread rubber on the center by adding a hot melt adhesive to the thread rubber to glue it to the center. It is not possible to fix a thermoset rubber thread to the center by melting a portion of the thread because thermoset rubber threads are cured and cannot be remelted and flowed.

U.S. Pat. No. 5,704,854: "Three-piece Solid Golf Ball" discloses an invention whereby a thermoplastic polyester elastomer is molded as a relatively thin, solid intermediate layer between the center and the cover to provide some of the control characteristics or spin response of a rubber thread wound golf ball with the durability of a two-piece ball. As a three-piece solid golf ball, it does not contain a thread wound layer. They make no mention or reference of using a wound oriented thermoplastic polyester elastomer golf ball thread structure as the intermediate layer.

U.S. Pat. No. 5,965,669: "Multi-layer golf ball and composition" discloses a three-piece solid golf ball using a molded thermoplastic in the mantle layer where the preferred material is a polyetherester block copolymer with a specific gravity below 1.2. There is no mention of or reference of using a wound oriented thermoplastic polyester elastomer golf ball thread structure as the intermediate mantle layer.

The above-mentioned patents have improved the thermoset rubber thread wound golf balls and the three piece solid golf balls but still leave room to improve the combination of properties of spin receptivity of the wound balls in combination with the durability, uniformity and thermoplastic processing ease of the solid balls. The prior art discloses thermoset rubber thread wound balls and solid balls with molded thermoplastic elastomer layers. Nowhere has it been disclosed to use thermoplastic elastomer threads as a thread wound layer; moreover, nowhere has it been mentioned to use oriented thermoplastic elastomer threads as the wound layer. Specifically there is a need for a WOTEGBTS which: can be readily and consistently produced without the need for complex vulcanization processes; has highly precise dimensions; has high compressive resiliency and tensile elasticity; has precision controlled property profiles as a function of radial distance from the ball center; can be formed from threads of varying cross sectional geometry to tailor ball property response; can be recycled; and has higher strength and durability. The WOTEGBTS provides a thread wound golf ball with improved combinations of good spin for ball control on iron or wedge shots whilst providing for higher hardness and long travel with driver shots.

DISCLOSURE OF THE INVENTION

The Oriented Thermoplastic Elastomer Thread Wound Golf Ball invention includes Oriented Thermoplastic Elastomer thread wound structures with one or more of the following precision controlled, engineered compositional elements: constant mechanical properties; controlled varying mechanical properties; a constant winding tension; a controlled varying winding tension; thread cross sectional shapes or profiles; constant cross sectional areas; controlled varying cross sectional areas; threads wound at constant or varying tension; threads of various cross sectional shapes; threads of constant or varying cross sectional area; threads of constant or varying mechanical property profiles.

The invention also includes an oriented thermoplastic elastomer thread wound golf ball with high compressive resiliency and tensile elasticity. Generally, any thermoplastic elastomer or rubbery thermoplastic material capable of forming an oriented thread of sufficient structural integrity is useful in the invention. Also included in the invention are multi-component threads where at least one component is an oriented thermoplastic elastomer thread.

In a preferred embodiment, the thread wound structure or structures in the thread wound golf ball comprises: (a) 100 percent to 0 percent polyetherester or copolyetherester block copolymer based upon the weights of components (a) and (b); (b) 0 percent to 100 percent polyetheramide or copolyetheramide based upon the weights of components (a) and (b); (c) 0 parts to 50 parts by weight of other modifying polymers and additives based upon the sum weights of components (a) and (b).

In one embodiment the core is constructed by winding the oriented thermoplastic elastomer thread about itself. This can be done by first folding (winding) the thread(s) over itself several times and then winding the remaining thread(s) in a conventional manner.

In another embodiment the core is constructed by winding the oriented thermoplastic elastomer threads around a center or inner sphere of any dimension or composition, such as thermoset solid rubber sphere, a thermoplastic solid sphere, wood, cork, metal, or any material known to one skilled in the art of golf ball manufacture. The inner sphere could be a liquid filled sphere or shell such as a rubber sack, a thermoplastic or metallic shell design, in which the liquid could be of any composition or viscosity. It is feasible to construct such a center with a void or gas center. In another embodiment, the center can be filled with a liquid, a gel, a paste, a cellular foam, or a gas.

Finally, an outer cover is molded around the completed core (the core contains the rest of the ball which includes at least one oriented thermoplastic elastomer thread wound layer) to produce the ball. Any process that results in accurate and repeatable central placement of the core within the cover is acceptable. Generally, covers are applied by compression molding, injection molding, or casting cover material over the core.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims.

In this respect, before explaining at least one embodiment of the invention in detail, it is to be understood that the invention is not limited in its application to the details of construction and to the arrangements of the components set forth in the following description or illustrated in the drawings. The invention is also capable of other embodiments and of being practiced and carried out in various ways. Also, it is to be understood that the phraseology and terminology employed herein are for the purpose of description and should not be regarded as limiting in any way the scope of this invention or claims.

As such, those skilled in the art will appreciate that the conception, upon which this disclosure is based, may be readily utilized as a basis for the designing of other structures, methods and systems for carrying out the several purposes of the present invention. It is important, therefore, that the claims be regarded as including such equivalent constructions and methods insofar as they do not depart from the spirit and scope of the present invention.

Further, the purpose of the abstract is to enable the U.S. Patent and Trademark Office, International Patent Offices, PCT Patent Authorities, any and all National Patent Offices, and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by claims, nor is it intended to be limiting as to the scope of the invention in any way.

It is therefore an object of the present invention to provide a Oriented Thermoplastic Elastomer Thread Wound Golf Ball which has many of the advantages of the golf balls mentioned heretofore and many novel features that result in a Oriented Thermoplastic Elastomer Thread Wound Golf Ball which is not anticipated, rendered obvious, suggested, or even implied by any of the prior art whether cited or referenced above or not, either alone or in any combination thereof.

It is another object of the present invention to provide a new and novel Oriented Thermoplastic Elastomer Thread Wound Golf Ball which may be easily and more efficiently manufactured, taught and marketed.

It is further object of the present invention to provide a new and novel Oriented Thermoplastic Elastomer Thread Wound Golf Ball which is of durable and reliable construction and method.

An even further object of the present to provide a new and novel Oriented Thermoplastic Elastomer Thread Wound Golf Ball which is susceptible of a low cost of manufacture with regard to both materials and labor, and which accordingly is susceptible of low prices of sale to the consuming public, thereby making such Oriented Thermoplastic Elastomer Thread Wound Golf Ball economically available to the buying public.

Still yet another object of the present invention is to provide a new and novel Oriented Thermoplastic Elastomer Thread Wound Golf Ball which provides in the apparatuses and methods of the prior art some of the advantages thereof, while simultaneously overcoming some of the disadvantages normally associated therewith.

These together with other objects of the invention, along with the various features of novelty which characterize the invention, will be pointed out with particularity in the claims. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE FIGURES

FIG. 1 is a table describing the golf ball rubber threads used to produce the thread wound structure examples discussed in the Examples section below.

FIG. 2 is a diagram describing the Wound Structure Compressive Resiliency Tester.

FIG. 3 shows the Thread Wound Structure Compressive Resilience. The resilience is the rebound height of a ⅝ inch diameter chrome steel ball dropped 36 inches onto the thread wound structure produced from winding a carbon steel insert with 13 feet of golf ball thread. The higher the rebound the higher the resilience of the thread wound structure. The WOTEGBTS of the current invention have surprisingly similar rebound properties as a sample thread rubber obtained from a commercial golf ball.

FIG. 4 is a table listing the maximum percentage (%) extension of the various golf ball threads under specific tensions making up the thread wound structure. Also listed is the final percentage (%) extension which shows a comparison of the final lengths of the various golf ball threads after the load was removed as a function of the initial lengths before the load was employed. To have good tensile elasticity the threads should return to their initial size after the load was removed (i.e. a final percentage (%) extension of about 100%). The WOTEGBTS' oriented thermoplastic elastomer threads have good tensile elasticity and are much stronger than a sample of thread rubber obtained from a commercial golf ball thread wound structure.

FIG. 5 is a table showing the relative change in extension with increasing load or tension versus the extension at an initial load of about 300 psi. This is a demonstration of the extensional response to the high tension that occurs during a club shot of WOTEGBTS versus a prior art thermoset rubber thread wound structure formed at 300 psi winding tension. It shows that the threads in the WOTEGBTS of the current invention have similar percent extensibility between about 300 psi and 1300 psi as a thread rubber sample obtained from a commercial golf ball.

FIG. 6 is a graphic representation of the data in FIG. 5. It illustrates that the WOTEGBTS of the current invention have similar percentage (%) extensibility between about 300 psi and 1300 psi as a thread rubber structure formed from prior art thermoset rubber threads obtained from a commercial golf ball. It also shows that the tension built upon extension can be readily controlled by the amount of draw orientation in the threads of WOTEGBTS. It is very surprising that the WOTEGBTS samples have similar response as the stressed Titleist® 1 DT90 thread rubber sample. This is not expected in view of the much higher extension of the prior art thread rubber versus the oriented thermoplastic elastomer golf ball threads at low tensions (i.e. 4.75 times initial length at only 175 psi for the thermoset rubber sample versus only about 1.03 times initial length for the oriented thermoplastic elastomer golf ball threads).

BEST MODE FOR CARRYING OUT THE INVENTION

Preferred Wound Oriented Thermoplastic Elastomer Golf Ball Thread Structure Design and Composition for Oriented Thermoplastic Thread Wound Golf Ball I. Oriented Thermoplastic Elastomer Golf Ball Thread Structure Design WOTEGBTS has novel controlled mechanical property profiles, not possible with thermoset thread rubber structures of prior art golf balls, across the oriented thermoplastic elastomer thread wound layer as a function of radial distance from the golf ball center, through application of one or combinations of factors that are engineered over the length of thread used to make the thread structure:

(a) constant oriented thread winding tension or (b);

(b) varied oriented thread winding tension;

(c) oriented thread with conventional thread cross sectional shapes or (d);

(d) novel oriented thread cross sectional shapes;

(e) constant oriented thread cross sectional areas or (f);

(f) varied oriented thread cross sectional areas;

(g) constant oriented thread mechanical properties or (h);

(h) varied oriented thread mechanical properties.

II. Oriented Thermoplastic Elastomer Golf Ball Thread Composition

The invention also includes an oriented thermoplastic elastomer thread wound golf ball composition with high compressive resiliency and tensile elasticity. Generally, any thermoplastic elastomer or rubbery thermoplastic material capable of forming an oriented thread is useful in the invention. Also included in the invention are multi-component threads where at least one component is an oriented thermoplastic elastomer thread. One preferred embodiment is:

(a) 100 percent to 0 percent polyetherester or copolyetherester block copolymer based upon the weights of components (a) and (b);

(b) 0 percent to 100 percent polyetheramide or copolyetheramide based upon the weights of components (a) and (b); and (c) 0 parts to 50 parts by weight of other modifying polymers and additives based upon the sum weights of components (a) and (b).

Some non-limiting examples of thermoplastic poyetherester multiblock copolymers (a) are made from terephthalic acid, 1,4-butanediol, and polytetramethylene glycol or polypropylene glycol so that the butylene terephthalate component forms hard segments and the polytetramethlyene glycol or polypropylene glycol form soft segments. The poyetherester multiblock copolymers preferred have Shore D hardness equal to or less than 55 D. Non-limiting examples of poyetherester multiblock copolymers are Hytrel® grades 3548L, 4056 and 5556 commercially available from DuPont.

Some non-limiting examples of polyetheramide or copolyetheramides (b) are Pebax® polymers commercially available from Elf Atochem. The polymers with Shore D hardness in the range of 25 D to 50 D are preferred with the softest being the most preferred.

Base polymer composition (a)+(b) can be mixed, reactively blended or alloyed with other polymers (c) and are useful in WOTEGBTS' of the invention so long as the resulting blend thread maintains the resilience and high elasticity characteristic of (a) or (b) when oriented. Those skilled in the art will realize that these properties will be maintained to some extent as long as (a)+(b) is present in the final thread as a continuous or co-continuous phase morphology and as long as oriented threads of sufficient structural integrity and thermoplastic nature can still be formed.

Non-limiting examples of such other polymers (c) that could be added as a way to modify the hardness (for example) of the golf ball could be ionomer resins, ethylene acrylate copolymers, styrene butadiene rubbers, polyolefins, polyurethanes, nitrile rubbers, EPDM rubbers, other rubbery polymers, chemically functionalized versions of any of these polymers and any other melt processible thermoplastic polymers. Chemically functionalized refers to chemical groups on the polymer that can form covalent or ionic bonds with (a) and/or (b) when melt blended. In addition these blends may be dynamically vulcanized in cases where (c) is a cross linkable polymer. Non-limiting examples of some crosslinkable polymers including blends of these polymers are butadiene rubber, EPDM, isoprene, ethylene alkylacrylate, etc.

Additives and stabilizers (c) can also be mixed with (a)+(b). Useful additives are antioxidants, lubricants, reinforcements or fillers to adjust specific gravity, hardness, lubricity, tensile strength, compressive elasticity, heat stability, color, etc. Fillers such as zinc oxide, titanium dioxide, barium sulfate can be used to adjust specific gravity. Fillers such as silicon dioxide can be added as an anti-block to control thread stickiness. External lubricants such as conventional polyester or polyamide thread lubricants and anti-static agents are useful. Internal process aids and lubricants can also be present such as fluoropolymers, fluorinated oils, silicone oils, mineral oils, fatty esters or amides and more conventional plasticizers without deviating from the object of the invention.

Thread Formation

Oriented thermoplastic elastomer threads are formed by melt extrusion through a die of desired cross sectional shape. Generally these die holes will be 2–14 times or more as large as the desired final golf ball cross sectional thread size.

The cross sectional sizes of interest are those generally produced via monofilament type extrusion and draw or compression orientation processes. These are commercially available processes understood by those skilled in the art.

In these processes the polymer and additive composition are generally added to an extruder as solids where they are melted and mixed. The melt exiting the extruder can exit through a die directly or else can be fed to a melt pump before exiting the die for very precise flow and resulting thread diameter control. The melt is quenched in air or water at a selected temperature and solidified, the solidified thread is then drawn around and through a series of rolls operated at different speeds to draw or shrink the threads in the draw orientation process. Several rolls are used for each velocity to eliminate slipping that would occur with only one roll. Each of these series of rolls is often referred to as a roll stand (because it is contained within one stand or device). One or more stages of draw orientation may be used. In between the rolls are ovens which serve to supply heat necessary for proper control over the drawing process. The orientation process is optionally done in the presence of water or steam Those skilled in the art will understand that later stages of these draw orientation processes often actually involve some controlled thread shrinkage, even though the overall process is one providing draw orientation.

The compression orientation process is similar to the draw process except that the thread is oriented by squeezing between nip rolls instead of stretching them. This process introduces a somewhat different orientation to the thread than the drawing process but produces oriented thermoplastic elastomer threads suitable for use in the invention. One or more stages of compression orientation may be used.

Generally polymers are drawn or compression oriented at temperatures above their glass transition temperature (Tg) but below their melting point. The amount of draw orientation is usually referred to as the number obtained by dividing the final roll speed (linear velocity) by the first roll speed in the case of draw orientation. Thus if the final roll speed was 40 feet per minute and the first roll speed was 10 feet per minute the draw ratio would be 4. In cases where compression orientation is used the draw ratio is the ratio of quenched or solidified thread cross sectional area before compression divided by the final thread cross sectional area.

In the draw oriented threads used to prepare the WOTEGBTS in the Examples section below, draw ratio refers to the ratio of the final roll speed divided by the initial roll speed because these threads were draw oriented.

Draw or compression orientation of solid threads are the preferred processes with draw or compression orientation of the thread heated to a temperature above the polymer compositions glass transition temperature (Tg) being the most preferred.

The thread size is controlled by the die, the volumetric output of the extruder or melt pump and the draw ratio. In the most preferred process, the thread exiting the last rolls can be used directly or conveniently wound onto a spool and later used to prepare the oriented thermoplastic elastomer thread wound golf ball of the invention. Usually there are multiple threads manufactured at once.

Another object of the current invention is to provide oriented thermoplastic elastomer thread wound golf balls wherein the thread wound layer in the golf ball has a continuous or step wise evolution of modulus, strength and extensional response in a continuum or step wise manner extending from the center throughout the thread layer toward the outside of the ball. This has never before been possible with prior art thread rubber compounds due to the limiting nature of the thermoset rubber threads.

The continuous or stepwise evolution of modulus, strength/extensional response is a novel aspect of the WOTEGBTS achievable in three ways. In the first method, the thread (or threads) themselves have a varied property profile along the length of thread constituting the thread wound layer and it is wound at constant tension. In the second method (discussed under "Preparation of Oriented Thermoplastic Thread Wound Golf Balls" section below) the thread has uniform properties along its length but is wound at varied tension during manufacture of the thread wound layer. This varied tension results in varied properties. The third method is to combine the first two by varying both the thread and the winding tension.

The varied property WOTEGBTS (first method) is manufactured from thread formed in a novel process. Precise variable control of the extrusion volumetric output and speeds of the draw rolls can produce a continuously or stepwise varying orientation and/or cross sectional size in a time period that defines one oriented thermoplastic elastomer thread length which constitutes the total thread length needed to make one WOTEGBTS. The process time period is repeated continuously to manufacture thread lengths of controlled property profiles. The length of thread for each golf ball can be marked periodically on the thread with a dye, paint, mechanical marking device, etc. after the last roll stand, or some other place in the process, to signal the end of one thread length and the beginning of the next thread length. This allows the single threads to be differentiated later during the golf ball winding step.

In this way a single golf ball thread can be manufactured with a varying draw orientation ratio which changes the modulus, strength and extensional response within the thread layer whilst maintaining the precise dimensional control inherent in the process. This method also is used to (either with or without the varying draw orientation) continuously or step wise change the cross sectional area of thread as desired to obtain specific golf ball performance attributes.

This novel invention provides a WOTEGBTS that yields a variety of responses to the range of shots needed for optimal performance. It is not possible to achieve this varied response profile within the prior art wound thermoset rubber golf ball thread structure.

One non-limiting example of the type of response profile that is achieved is to have the typical soft feel and control during short shots associated with an easily compressible outer thread rubber layer. However upon drive shots where greater ball distortion occurs the modulus of the wound thread rubber layer rises either stepwise or continuously with ball compression to limit overall compression in proportion to shot force and direct the maximum amount of available force into a long distance shot This continuum or stepwise ball response available as a function of ball compression (shot type) originating within one material layer of the golf ball is unprecedented and is a key attribute of the oriented thermoplastic elastomer thread wound golf ball of the current invention.

Proir art thread wound golf balls have a soft region of thread that responds one way and which then transitions abruptly as the center comes more into compression. Therefore, the thread wound layer of the current invention can be a much greater percentage of the ball mass in comparison with prior art thermoset rubber thread wound golf balls and different centers can be considered that were not before applicable.

Thread Geometry

Thread geometry is not constrained in the current thermoplastic thread wound golf ball invention as it has been for prior art rubber threads used in commercially available thread wound golf balls. This inherent advantage of the current invention adds to its usefulness in allowing geometry of thread cross section to be varied to affect ball hardness, durability and response.

The prior art thermoset rubber threads used in commercial golf balls are usually rectangular in cross section. These prior art threads are made by mixing a batch of rubber and ingredients, forming a sheet, and then heating the sheet to cure the rubber. Threads are then sliced from this sheet. It is difficult to precisely control the sheet thickness, to uniformly heat the sheet to affect uniform cure and uniform properties, and to cut the sheet to give smooth edges. It is not practical and perhaps not even possible to consider cutting round edges on the rubber or to form smooth surfaces to reduce defects that act as stress concentration points or defects. The inherent variability of prior art wound thermoset rubber golf ball threads in diameter and defects reduce the precision of the golf ball.

Prior art thermoset rubber golf ball thread is not uniform throughout in size or properties and varies in a random manner. The rubber for the threads is generally produced in a batch process which introduce additional batch to batch variability. The curing agent or agents must be mixed uniformly and this too adds to lack of precision. These defects are likely large contributors to the well known thread breakage problem that can detract from efficiency in prior art thread wound golf ball manufacture.

My invention greatly reduces or eliminates compositional variability, eliminates the dimensional variability issue, allows geometric design flexibility and precisely engineered property profiles and allows for recycling of waste thread material. Waste thread scrap can be recycled into the extrusion and orientation process used to make the thermoplastic threads. The extruded surfaces are smooth, defect free and of highly precise dimensional tolerance in comparison with prior art thermoset rubber threads. In addition the cutting step is unnecessary because the size is directly controlled by the extrusion orientation process in thermoplastic golf ball threads of the current invention. As a result the precision and quality in terms of compositional uniformity, properties and size of the thermoplastic golf ball threads of the present invention are greatly improved over prior art thermoset rubber threads.

Inherently, the shape can be varied in the thermoplastic golf ball threads of the present invention by fabricating different extrusion dies of different shapes. Round, square, rectangular, rectangular with rounded corners, cloverleaf and many other shapes are possible and provide an important source of engineering design flexibility inherent in the current invention. Hollow thermoplastic golf ball threads of this invention can also be produced.

Hollow threads, in one non-limiting example could have the hollow varied from some percentage (e.g. 30%) over the length of thread to about 0% (when made with a gas injection die) to change the density distribution through the thread wound layer to impart specific ball characteristics.

A star shaped type of thread, in another non-limiting example, could be made to have similar effect by changing the cross sectional area over the length of thread. In cases with geometric protrusions from the thread core, these protrusions can be made much less pronounced by changing the extruder output (thus effectively also changing the geometric shape of the thread). In this way the thread packing during winding can be varied to impart a distribution of density throughout the thread wound layer.

Thermoplastic golf ball threads of the current invention can also take the form of multi-component threads to obtain certain performance characteristics. One Multi-component thread is a thread formed from two or more separate polymer melts joined together within a die to form a thread with distinctly separate polymer composition regions. For example but not limiting to the invention are multi-component thread geometry types for use in paper maker's fabrics described in U.S. Pat. No. 5,617,903. This is different than two or more pre-formed threads physically twisted or otherwise joined together, which can also be used in the present invention as multi-component threads, to wind the golf ball. In any of these cases, one thread or component could be chosen to have a lower melting temperature than the other component. Heat could be applied before, during or after winding to affect partial or full fusion of the low melting component which results in a new class of balls with a hybrid solid-wound layer and character.

This new design flexibility is useful to prepare very uniform, custom performance balls for varying conditions and golfer expertise and cannot be achieved by prior art golf ball technologies.

Preparation of Oriented Thermoplastic Elastomer Thread Wound Golf Balls

In general, the WOTEGBTS of the new Oriented Thermoplastic Elastomer Thread Wound Golf Balls can be made essentially by winding a suitably designed oriented thermoplastic elastomer golf ball thread around any of the prior art golf ball centers. It may be advantageous to shrink the center size in order to maximize the benefit of the new WOTEGBTS. The limiting case of this would be to have WOTEGHTS form the center itself. The size of the center and exact thread properties can be adjusted depending upon the target ball performance type to be made. A typical example is provided below.

The winding process for the new Oriented Thermoplastic Elastomer Thread Wound Golf Balls has several inherent advantages versus prior art thermoset rubber thread wound balls. In some cases the new threads can be fastened to the center by heating the end of the thread or the center which will effectively cause the end to melt and adhere to the center. The thread end effectively behaves as a hot melt adhesive and glues the thread directly to the center without the need for tying or other adhesives. In a similar way the end at the outer boundary of the thread wound layer could be adhered to the thread wound layer without necessarily requiring a knot.

The winding process also can provide the second method (see Thread Formation section above for the first and third methods) to form a WOTEGBTS with a novel continuous or stepwise radial evolution of modulus, strength/extensional response. In this method, the WOTEGBTS could be made from a thread or threads of uniform (or varying) property profile throughout the thread length. However, the tension is changed during the winding stage according to a precise plan to vary the property profile of wound thread throughout the thread wound layer. This method is very much more effective in WOTEGBTS compared with prior art thermoset rubber wound balls because the WOTEGBTS can be formed at much higher tensions without breaking the threads in comparison with prior art thermoset thread rubber balls. Therefore the properties can be varied over a wide range throughout the WOTEGBTS of the current invention merely by winding at varied tension.

The center or inner sphere may be of any dimension or composition. The center is a solid sphere. The center could be a thermoset solid sphere, a thermoplastic solid sphere, an oriented Thermoplastic elastomer thread folded, rolled, wrapped or wound into a solid sphere, wood solid sphere, cord solid sphere, metal solid sphere or any material known to one skilled in the art of ball manufacture. Similarly, the center could be a liquid filled sphere or shell such as a thermoset rubber sack, a thermoplastic, thermoset or metallic shell design. The liquid employed could be of any composition or viscosity. It is also feasible to construct such a center with a void or gas center.

In a non-limiting example the center or inner sphere can have a diameter in the range of 0.1–1.5 inches.

The wound layer(s) contains at least one oriented thermoplastic elastomer thread which increases the overall diameter to about 0.5–1.6 inches or more.

The cover layer(s) provides the interface between the ball and a club. Desirable cover properties are moldability, high abrasion resistance, high cut resistance, high tear resistance and high resilience among others. The cover layer(s) has a thickness of about 0.03 inches to about 0.30 inches.

The golf balls of the present invention can be made by any conventional process employed in the golf ball art. In a non-limiting example the golf ball is produced by injection of compression molding the solid center. The oriented thermoplastic elastomer thread is then wound around the solid center to form the thread wound layer. Different oriented thermoplastic elastomer threads can be used optionally with different winding tensions depending upon the desired results for ball performance. The cover layer or layers is then injection or compression molded or cast about the wound layer which processes are well known in the art.

In another non-limiting example, a golf ball of the present invention can be formed by initially forming a shell by compression molding hemispherical cups, the cups are bonded together to form the shell to create a cavity which is filled with fluid or liquid to form the center. The oriented thermoplastic elastomer thread is then wound around the solid center to form the thread wound layer. Different oriented thermoplastic elastomer threads can be used optionally with different winding tensions depending upon the desired results for ball performance. The cover layer or layers is then injection or compression molded or cast about the wound layer.

A representative base composition for forming a solid golf ball center, which is comprised of at least one thread wound layer comprises polybutadiene and, in parts by weight based on 100 parts of polybutadiene, 0–50 parts of a metal salt diacrylate, dimethacrylate, or monomethacrylate, preferably zinc diacrylate. Commercial sources of polybutadiene include Cariflex 1220 produced by Shell Chemical, Neocis BR40 manufactured by Enichem Elastomers, and Ubepol BR150 manufactured by Ube Industries, Ltd. If desired the polybutadiene can also be mixed with other elastomers known in the art, such as natural rubber, styrene butadiene, and/or polyisoprene in order to further modify the properties of the center. When a mixture of elastomers is used, the amounts are based upon 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium, or nickel. Zinc diacrylate is preferred, because it provides golf balls with a high initial velocity. The zinc diacrylate can be of various grades of purity. Zinc diacryalte containing less than about 10% zinc stearate is preferred. More preferable is Zinc diacrylate containing about 4–8% zinc stearate. Zinc diacrylates suitable for use in the invention can be obtained from the Sartomer Corporation. The preferred concentrations of zinc diacrylate are 0–50 pph (parts per hundred rubber) and preferably 10–30 pph based upon 100 pph of polybutadiene or alternatively, polybutadiene with a mixture of other elastomers that equal 100 pph.

Free radical initiators are used to promote cross-linking of the metal salt diacrylate, dimethacrylate, or monomethacrylate and the polybutadiene or mixture of polybutadiene with other elastomers. Suitable free radical initiators for use in the invention include but are not limited to peroxide compounds, such as dicumyl peroxide, 1,1-di(t-butylperoxy) 3,3,5-trimethyl cyclohexane, 1-a bis (t-butylperoxy) diisopropylbenzene, 2,5-dimethyl-2,5 di(t-butylperoxy) hexane, or di-t-butyl peroxide, and mixtures thereof Other useful initiators would be readily apparent to one with ordinary skill in the art. The initiator(s) at full activity are preferably added in an amount ranging from 0.05 pph to 2.5 pph based upon 100 parts of butadiene, or butadiene mixed with one or more elastomers. More preferably the amount of initiator ranges between about 0.15 pph and 2 pph and most preferably between 0.25 pph and 1.5 pph.

A typical golf ball core incorporates between 1 pph and 50 pph of zinc oxide in a zinc diacrylate-peroxide cure system that crosslinks polybutadiene during the core molding process.

The compositions of the present invention may also include fillers, added to the elastomeric composition to adjust the density or specific gravity of the core. The term "fillers" as used herein includes any compound or composition that can be used to vary the density and other properties of the golf ball core. Fillers used in the golf ball core of the present invention include, for example, zinc oxide, barium sulfate, and regrind (which is ground, recycled core material). The amount and type of filler used is determined by the amount and weight of other materials used in the composition, since a maximum golf ball weight of 1.620 ounces (45.92 grams) has been established by the USGA. Appropriate fillers range in specific gravity from about 0.7 to about 5.6 grams per cubic centimeter.

Antioxidants may also be included in the elastomer centers produced according to the present invention. Antioxidants useful in the present invention include, but are not limited to quinoline type antioxidants, amine type antioxidants and phenolic type antioxidants.

Other ingredients such as accelerators, e.g., tetra methylthiuram, peptizers, processing aids, processing oils, plasticizers, dyes and pigments, as well as other additives well known to those skilled in the art may also be used in the present invention in amounts sufficient to achieve the purpose for which they are typically used.

A cis-trans conversion catalyst may also be included in the present invention. The catalyst may be an organosulfur or metal-containing organosulfur compound, a substituted or unsubstituted aromatic organic compound that does not contain sulfur or metal, an inorganic sulfide compound, an aromatic organometallic compound, or mixtures thereof. A "cis-trans catalyst" herein, means any compound or a combination thereof that will convert at least a portion of cis-polybutadiene isomer to trans-polybutadiene isomer at a given temperature.

A center can also be a liquid-filled shell. The shell can be filled with a wide variety of materials including air, water solutions, gels, foams, hot-melts, other fluid materials and combinations thereof, as described in U.S. Pat. No. 5,683,312 which is incorporated herein by reference.

Examples of suitable liquids include either solutions such as salt in water, corn syrup, salt in water and corn syrup, glycol and water as oils. The liquid can further include pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such as a styrene-butadiene-styrene rubber and paraffnic and/or napthenic oil. Examples of suitable melts include waxes and hot-melts. Hot-melts are materials which at or about normal room temperatures are solid but at elevated temperatures become liquid. A high melting temperature is desirable since the liquid core is heated to high temperatures during molding of the cover.

The liquid within the shell can be a reactive liquid system which combine to form a solid. Examples of suitable reactive liquids are silicate gels, agar gels, peroxide cured polyester resins, two part epoxy resin systems, and peroxide cured liquid polybutadiene rubber compositions. It is understood by one skilled in the art that other reactive liquid systems can be likewise be utilized depending upon the physical properties of the shell and the physical properties desired in the resulting finished golf balls.

The cover means of the golf ball can be comprised of one or more layers and is generally made of polymeric materials such as ionic copolymers of ethylene and an unsaturated monocarboxylic acid which are available under the trademark "SURLYN" of DuPont or "IOTEK" or "ESCOR" from Exxon. These are copolymers or terpolymers of ethylene and methacrylic acid or acrylic acid partially neutralized with zinc, lithium, sodium, magnesium, potassium, calcium, magnesium, potassium, calcium, manganese, nickel and the like.

In another embodiment, the cover means can be formed from mixtures of zinc, lithium and/or sodium ionic copolymers or terpolymers.

Also, "SURLYN" resins for use in the cover are ionic copolymers or terpolymers in which sodium, lithium, or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylate, crotonic, maleic, fumaric or itaconic acid.

The invention can also be used in conjunction with covers having polymeric materials such as:

(1) Vinyl resins such as those formed by the polymerization of vinyl chloride, or by copolymerization of vinyl chloride with vinyl acetate, acrylic esters or vinylidene chloride.

(2) Polyolefins such as polyethylene, polypropylene, polybutylene and copolymers such as ethylene methacrylate, ethylene ethacrylate, ethylene vinyl acetate, ethylene methacrylic or ethylene acrylic acid or propylene acrylic acid and copolymers and homopolymers using single-site catalysts.

(3) Polurethanes such as those prepared from polyols and diisocyanates or polyisocyanates and those disclosed in U.S. Pat. No. 5,334,673.

(4) Polyureas such as those disclosed in U.S. Pat. No. 5,484,870.

(5) Polyamides such as poly(hexamethylene adipamide) and others prepared from diamines and diacids, as well as those from amino acids and lactams, and blends of polyamides with "SURLYN", polyethylene, ethylene copolymers, ethylene-propylene diene terpolymer, etc.

(6) Acrylic resins and blends of these resins with polyvinyl chloride, elastomers, etc.

(7) Thermoplastics such as urethanes, polycarbonates, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide) such as "PEBAX" sold by ELF Atochem.

(8) Polyphenylene oxide resins, or blends of polyphenylene oxide with high impact polystyrene as sold under the trademark "NORYL" by General Electric Company, Pittsfield, Mass.

(9) Thermoplastic polyesters such as polyethylene terephthalate, polybutylene terephthalate, polyethylene terephthalate and polybutylene terephthalate modified with glycols and polyols and elastomers sold under the trademarks "HYTREL" by DuPont and "LOMOD" by General Electric Company.

(10) Blends and alloys, including polycarbonate with acrylonitrile butadiene styrene, polybutylene terephthalate, polyethylene terephthalate, styrene maleic anhydride, polyethylene, elastomers, etc. And polyvinyl chloride with acrylonitrile butadiene styrene or ethylene vinyl acetate or other elastomers. Blends of thermoplastic rubbers with polyethylene, polypropylene polyacetal, polyamides, polyesters, cellulose esters, etc.

(11) Thermoplastic or thermoset polyurethanes.

(12) Balata.

(13) Metallocene.

(14) Blends of any of the cover means' materials already listed in this application.

Preferably the cover means is comprised of polymers such as ethylene, propylene, butene-1 or hexane-1 based homopolymers and copolymers including functionalized monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, polyethylene terephthalate, polybutylene terephthalate, poly(ethylene vinyl alcohol), polytetrafluoroethylene and their copolymers including functional comonomers and blends thereof. Still further, the cover means is preferably comprised of a polyether or polyester thermoplastic urethane, a thermoset polyurethane, and ionomer such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in 5–35 weight percent. More preferably in a low spin rate embodiment designed for maximum distance, the acrylic or methacrylic acid is present in 15 to 35 weight percent, making the ionomer a high modulus ionomer. In a high spin embodiment, the cover means includes an ionomer where an acid is present in 10 to 15 weight percent and includes a softening comonomer.

This novel invention provides an oriented thermoplastic elastomer thread wound golf ball with a variety of responses to the range of shots needed for optimal performance.

The WOTEGBTS should be produced faster and more efficiently (less thread breakage during winding) to lower production costs versus prior art wound thermoset rubber golf ball structures because WOTEGBTS has far fewer defects and is stronger.

EXAMPLES

The Oriented Thermoplastic Elastomer Thread Wound Golf Ball of this invention is novel compared with all previous golf balls. It offers a range of performance superior to previous rubber thread wound golf ball. This is demonstrated by comparing the properties of the WOTEGBTS with a sample of wound thermoset rubber thread structure (hereinafter referred to as WTRTS). The thermoset rubber threads were obtained from a commercially available prior art thermoset rubber thread wound golf ball. The properties compared are compressive resilience or bounce and tensile strength and elasticity.

The Experimental Testing and Sample Examination Comparison Demonstrates:

1. The WOTEGBTS have similar compressive resilience (or bounce) as the prior art WTRTS.
2. WOTEGBTS surface smoothness and dimensional tolerance is superior to that of WTRTS.
3. Oriented thermoplastic elastomer threads of WOTEGBTS have far greater tensile strength than the prior art rubber threads.
4. Knotted oriented thermoplastic elastomer threads did not break while knotted thermoset rubber threads broke.
5. Oriented thermoplastic elastomer threads, of WOTEGBTS, which are draw or compression oriented (after quenching from the melt) above a draw ratio of 1.0 are especially preferred due to their higher elasticity.
6. Increasing or decreasing the amount of draw or compression orientation of the oriented thermoplastic elastomer threads readily adjusts their tension and extensional response (i.e. the tensile modulus which is related to hardness). This property relation can be adjusted to be less than, equal to or greater than (or all three within a single thread, if desired) the corresponding prior art wound rubber thread structure property relation under winding tensions applicable in a thread wound golf ball.

This invention is not limited to these examples.

Materials Used

Polyether ester:

Hytrel®4056, available from the DuPont Company was used as the raw material for the WOTEGBTS in the examples.

Prior Art Rubber Thread:

A Titleist® golf ball was obtained for the test. It had the following markings: "Titleist® 1", "DT Wound 90", with the word "Cummins" in blue letters. A hacksaw was used to carefully cut the cover without damaging any more than a few rubber threads nearest the surface. The cover was peeled off and the damaged threads removed. The rubber thread was then unwound. A continuous thread about 30 feet long was kept for testing.

Oriented Thermoplastic Elastomer Thread Preparation:

These were melt extruded of Hytrel® 4056 by a conventional thread or filament forming process, readily known by those skilled in the art, through a die with rectangular holes measuring 4.4 mm by 1.6 mm in size. The threads were oriented several ways. Some were draw oriented by standard methods on a commercially available thread or filament forming line equipped with draw roll stands and drawn above the polymer's glass transition temperature. Others were drawn cold by hanging specific weights on the un-oriented threads until stretch oriented for a period of time necessary for the stretching to stop. Details of the samples and the orientation process are given in FIG. 1.

Test Methods

Thread Wound Structure Preparation and Compressive Resiliency Test:

A compressive resiliency tester was custom built and is shown in schematically in FIG. 2. The materials to build the tester are standard items available at any hardware store such as Home Depot. The ⅝" diameter grade 25 chrome steel balls were purchased from McMaster-Carr Company in the USA.

A section of thread material to be tested approximately 15 foot long was cut. A central section of this cut piece 13 feet long was carefully measured and its ends and center marked with a red permanent marker. It was then vertically suspended with a weight on the end and carefully wound around a carbon steel insert under tension starting from the center of the thread. The winding was done such that the thread laid flat on its major surface without twists and with no space between wraps. A wrap or layer 0.5 inches wide was obtained and then the thread was wrapped back over the first layer. In cases where there was essentially no stretching the thread wound structure was 4 layers thick. In cases where the thread stretched, the wrapping process was continued in the 0.5" wide band until all of the thread was used. The ends were cut several inches outside of the wound 13 foot marks and fixed under tension with duct tape to the sides of the steel insert.

The wrapped insert was slid into the tester and the chrome steel ball dropped from 36 inches high through the track and onto the insert where it rebounded back up into the track. The insert was then slid out of the tester and the ball removed and the test repeated. Care was taken to mark the position of the insert in the tester so the same thread area was impacted with each ball drop. The maximum rebound height was observed and recorded. The higher the rebound the greater the resiliency.

Tensile Elasticity Test

The WOTEGBTS will have a tensile elasticity response in proportion to the oriented thermoplastic elastomer thread it is made from. In this test single threads were evaluated although the WOTEGBTS designation is still used to be consistent with the samples used in other tests. An appropriate length of the oriented thermoplastic elastomer golf ball thread or thermoset rubber thread was cut. A center section of this test thread piece was laid flat, measured and marked. This measurement was recorded as the initial length. A ⅝ inch steel rod about 12 inches long was slid through two eye bolt lag screws attached to basement ceiling joists so that the rod was level and there was 84 inches of clearance between the rod and the floor. The test piece of oriented thermoplastic elastomer thread or prior art thermoset thread rubber was attached to supported weights on one side and the rod on the other. Duct tape was used to attach the various threads to themselves after looping through weights or around the rod. Duct tape was used instead of a knot since the prior art rubber thread usually broke at the knot in preliminary trials. The oriented thermoplastic elastomer thread samples never broke during this testing regardless of whether or not a knot was used. For consistency the tape method was used for all samples to accommodate the prior art rubber thread.

The support was gently removed from the weights until the weights were suspended. The process of suspending the weights was done extra slowly and smoothly (over about 30 seconds) in cases where the threads began to stretch in order to avoid any jerking on the thread by the falling weight.

Once the fully suspended thread sample stabilized in length under load for one minute the marked center portion was re-measured and the value recorded as the dynamic length.

The load was then removed and the thread stabilized under no load for one minute. The marked portion was measured and this is the final length. The tension corresponding to this test was calculated by dividing the U.S. pounds of load by the unloaded thread cross sectional area. The thread cross sectional dimensions were measured before the test (to the nearest 0.1 mm) with a 10 power magnifying glass with reticle. The extension (max) and extension (final) were calculated as follows:

Extension (max)=100×(dynamic length/initial length)

Extension (final)=100×(final length/initial length)

Wound Elastic Response

A golf ball is distorted in shape to varying extents as the force from the club is transferred to the ball during a shot. The amount of distortion depends upon a number of factors but is manifested in tensile deformation of the ball surface and underlying layers. The tensile deformation basically involves the amount of stretching in response to a given force and the ability to recover to the resting geometry before the club shot. This is the wound elastic response.

It is necessary to wind the golf ball threads under significant tension in order to produce a ball with proper attributes of performance, durability and weight. Tensions of up to 1500 pounds per square inch or psi have been discussed in the literature. However, the sample thermoset thread rubber obtained from the Titleist® ball had insufficient strength to be wound at these tensions (it would break). Therefore a lower tension was chosen (about 300 psi). It is possible that the published winding tension for prior art thermoset rubber thread refers to the actual tension corrected for the significantly reduced cross sectional thread area under tension. The tensions listed in this work are calculated based upon the initial, unloaded cross sectional area.

The reason that approximately 300 psi instead of exactly 300 psi was used was because the various thread samples had different cross sectional areas, The weights used to provide the winding tension were available in limited weight classes. The approximate winding tension is inconsequential to the analysis since the response is actually a range of responses over a range of tensions. Therefore an approximate starting tension serves the purpose of this test.

FIG. 5 tabulates the wound elastic response of thread wound layers prepared at about 300 psi winding tension of several oriented thermoplastic elastomer thread wound golf balls and a prior art thermoset rubber thread wound golf ball. This wound elastic response was calculated from the data in FIG. 4 by normalizing the extension at higher tensions versus the starting extension at 300 psi. The examples chosen for this test had complete elasticity over the range of tensions employed.

The data from FIG. 5 is graphically represented in FIG. 6.

Test Results

Thread Wound Structure Compressive Resiliency Test Results:

Results are summarized in FIG. 3. The first control sample is the carbon steel insert without a thread wound layer. The carbon steel gave a rebound height of 7.5 inches.

The prior art thread layer obtained from the Titleist 1 golf ball could not be wound at a precise tension because it stretched beyond the limits of the tension winding procedure even under very low loads. The prior art thermoset rubber golf ball threads have very high extensions even under very low loads (i.e. these threads have a very low initial tensile modulus). Therefore the prior art thermoset rubber thread was carefully wound by hand. It gave a rebound height of about 10.3 inches.

The WOTEGBTS-1.0 gave a rebound height of 10.1 with a 120 gram weight providing the tension.

The WOTEGBTS-2.05 cd formed when a 940 gram weight hung on WOTEGBTS-1.0 caused it to stretch irreversibly. This stretched the sample to the height limit of the winding procedure resulting in the winding to be of relatively poor quality. The rebound height was 9.5 inches.

The WOTEGBTS-7.2 was wound with 940 grams tension to give a good quality winding and a rebound height of 10.5 inches.

The results show that the WOTEGBTS's of the current invention surprisingly have compressive resiliency or bounce similar to a prior art rubber thread wound structure even though the prior art thread has a very different initial extensional response to tension.

Tensile Elasticity Test Results (FIG. 4):

The Titleist® 1 DT Wound 90 rubber thread stretched a lot at very low tensions. For instance, at 178 psi it extended 475%. It also fully recovered to its initial length as revealed by its final extension of 100% from all tensions below the breaking tension as expected for a thermoset rubber. Therefore it had complete tensile elasticity over all tensions below the breaking tension (about 1300 psi).

It is important to understand that the complete range of extension is not applicable in the thread wound structure of a thread wound golf ball because the initial extension is that corresponding to the winding tension used to wind the ball.

Thus if 300 psi were used as the winding tension to produce a cohesive thread wound layer, the effective extensibility in the ball is given by dividing the extension at the breaking tension by the extension at the winding tension.

The WOTEGBTS-1.0 was completely elastic only up to around 519 psi where it had a 100% final extension value. At tensions above 519 psi all the way to 4150 psi it yielded in an increasing cold drawing response. Therefore, this particular example of an WOTEGBTS-1.0 made from Hytrel®4056 is most useful in golf balls where the maximum extension (as used in FIG. 5) is only 110% (i.e 10% stretching or extension).

It is expected that WOTEGBTS-1.0 made from different polymer compositions will have somewhat different tension/extensibility relationships.

A cold drawn sample, WOTEGBTS-1.8 cd stretches 153% at 1374 psi. It had complete elasticity over the range of extension as shown by its final value of 100%. Thus the elasticity of WOTEGBTS increases as the draw or compressive orientation ratio increases (WOTEGBTS-1.0 would only reversibly stretch to about 110%, while WOTEGBTS-1.8 cd would reversibly stretch to at least 153%).

A tension of 4150 psi was needed to stretch WOTEGBTS-4.7 to 154% extension. This is much higher than the 1374 psi needed to stretch WOTEGBTS-1.8 cd to 153%. Similarly, the tension to stretch WOTEGBTS-7.2 is higher still than that used to stretch WOTEGBTS-4.7 to a similar extension. All WOTEGBTS's -1.8 cd, -4.7 and -7.2 were completely elastic over the range of tensions tested.

The WOTEGBTS's did not ever break at the maximum tension tested which was over three times the breaking tension of the prior art Titleist® 1 DT90 thread.

These test results show that the elasticity of the WOTEGBTS can be increased by draw orienting the thread. The results also establish that WOTEGBTS is easily modified by changing the oriented thermoplastic elastomer thread draw ratio to have varying tension/extension responses as well as completely elastic behavior over a useful range of extensibility (defined by the response range of the prior art thermoset rubber golf ball sample).

Wound Elastic Response

The data in FIG. 4 was used to calculate the elastic response listed in FIG. 5 of the thread rubber structure as wound at about 300 psi tension. The calculation used was the extension at a given tension divided by the extension at about 300 psi.

These values represent the elastic response of the WOTEGBTS or wound prior art thermoset rubber golf ball thread structure to tensions that occur as the golf ball distorts in response to being hit with a golf ball club.

The results are illustrated graphically in FIG. 6. The WOTEGBTS had tensile extensional responses that were essentially the same, less than and greater than the prior art Titleist® 1 DT 90 thread wound golf ball structure. It is very surprising that the WOTEGBTS samples have similar response as the stressed Titleist® 1 DT 90 thread rubber sample. This is not expected in view of the much higher extension of the prior art thread rubber versus the oriented thermoplastic elastomer golf ball threads at low tensions (i.e. 4.75 times initial length at only 175 psi for the thermoset rubber sample versus only about 1.03 times initial length for the oriented thermoplastic elastomer golf ball threads).

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the figures and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Having described my invention, I claim:

1. An oriented thermoplastic thread wound golf ball comprising:

a cover;

at least one layer contained within the cover; and a layer of the at least one wound layer further comprising at least one oriented thermoplastic thread having a draw ratio greater than 1.1, wherein the oriented thermoplastic elastomer thread is wound into a generally spherical shape about a center point.

2. The oriented thermoplastic thread wound golf ball of claim 1, wherein the oriented thermoplastic thread has the same as wound draw ratio along its entire length.

3. The oriented thermoplastic thread wound golf ball of claim 1, wherein:

the oriented thermoplastic thread has an as wound draw ratio that varies continuously or stepwise along the length of the thread.

4. The oriented thermoplastic thread wound golf ball of claim 1, wherein the cross-sectional profile of the oriented thermoplastic thread varies.

5. The oriented thermoplastic thread wound golf ball of claim 1, wherein the oriented thermoplastic thread is a multi-component thread.

6. The golf ball of claim 1, further including a core about the center point of the golf ball, the oriented thermoplastic thread also wound about the core.

* * * * *